US008845121B2

(12) United States Patent
Jarzac et al.

(10) Patent No.: US 8,845,121 B2
(45) Date of Patent: Sep. 30, 2014

(54) POWER SUPPLY WITH SEALED PIVOTED USB CONNECTOR, FOR PORTABLE ILLUMINATION DEVICE

(75) Inventors: Sebastien Jarzac, Brignoud (FR); Boris Bouffay, Saint Bernard du Touvet (FR)

(73) Assignee: Zedel, Crolles (FR)

( * ) Notice: Subject to any disclaimer, the term of this patent is extended or adjusted under 35 U.S.C. 154(b) by 24 days.

(21) Appl. No.: 13/426,067

(22) Filed: Mar. 21, 2012

(65) Prior Publication Data

US 2012/0250295 A1 Oct. 4, 2012

(30) Foreign Application Priority Data

Mar. 30, 2011 (FR) ..... 11 00939

(51) Int. Cl.

| | |
|---|---|
| ***F21V 21/084*** | (2006.01) |
| ***F21L 4/08*** | (2006.01) |
| ***F21V 23/06*** | (2006.01) |
| *F21V 17/16* | (2006.01) |

(52) U.S. Cl.

CPC ..... *F21L 4/08* (2013.01); *F21V 17/164* (2013.01); *F21V 23/06* (2013.01)

USPC ..... 362/105; 362/106; 362/396; 362/439; 2/422

(58) Field of Classification Search

USPC ..... 362/105, 106.396, 439; 2/422

See application file for complete search history.

(56) References Cited

U.S. PATENT DOCUMENTS

| | | | | |
|---|---|---|---|---|
| 5,853,242 | A * | 12/1998 | Bouffay et al. | 362/191 |
| 6,626,703 | B2 * | 9/2003 | Hsin | 439/638 |
| 7,375,494 | B2 * | 5/2008 | Daniel et al. | 320/112 |
| 7,611,255 | B1 * | 11/2009 | Lagassey | 362/103 |
| 7,810,946 | B2 * | 10/2010 | Jarzac et al. | 362/204 |
| 2004/0145890 | A1 * | 7/2004 | Liao | 362/183 |
| 2006/0108979 | A1 * | 5/2006 | Daniel et al. | 320/112 |
| 2007/0182363 | A1 * | 8/2007 | Yang | 320/107 |
| 2008/0316733 | A1 * | 12/2008 | Spartano et al. | 362/105 |
| 2010/0238396 | A1 * | 9/2010 | Jannard | 351/158 |

FOREIGN PATENT DOCUMENTS

| | | | |
|---|---|---|---|
| DE | 20 2006 002 714 | U1 | 6/2006 |
| DE | 202006002714 | U1 * | 6/2006 |
| EP | 1 814 016 | A1 | 8/2007 |
| EP | 1814016 | A1 * | 8/2007 |

* cited by examiner

*Primary Examiner* — Ismael Negron
(74) *Attorney, Agent, or Firm* — Oliff PLC

(57) ABSTRACT

A power supply unit including an accumulator, a back support body with means configured for holding the back support body on a user's head and connect to a lighting device, at least one first module provided with a USB connector, and means for removably securing the at least one first module to the back support body. The back support body also includes a hollow element for receiving the connector, such hollow element being mounted so as to pivot around a transverse axis of the back support body.

9 Claims, 8 Drawing Sheets

POWER SUPPLY WITH SEALED PIVOTED USB CONNECTOR, FOR PORTABLE ILLUMINATION DEVICE

TECHNICAL FIELD OF THE INVENTION

The invention relates to a portable electric lamp, in particular a head light, including a front lighting device a power supply unit for the lighting module, this unit including an accumulator and a supply and communication connector, such as a Universal Serial Bus, a back support body, and holding means for the lamp on a user's head, connecting the front lighting device and the back support body.

STATE OF THE ART

Portable electric lamps are known whose accumulator is associated with a supply and communication connector, such as USB (Universal Serial Bus), which can be connected to an external source. This way, the lamp can be first reloaded, inter alia from a mains plug, a cigar lighter, or a solar panel. This connector can also be connect to a computer, in order to adjust various parameters of the lamp, such as in particular its autonomy or its lighting intensity.

The USB connector is generally configured as a socket, which must be connected to the above-mentioned source via an independent connecting cable, to ensure the charging of the battery, and the parameter setting of the level of lighting. It is thus necessary to permanently carry the connecting cable with the lamp.

Object of the Invention

The object of the invention consists in producing a portable electric lamp whose USB connector can be connected in a reliable way to an external source, independently of the conditions of use. The invention also aims at providing such a lamp whose connection between the connector and the external source can be implemented in a convenient way, and without any connecting cable.

The lamp according to the invention is characterized in that:

the power supply unit includes at least one first module which is provided with the USB connector, said first module comprising removable fixing means for the fixation to the back support body in order to define respective positions of fixation and separation while forming, in the position of fixation, a housing for receiving and protecting the USB connector, the back support body comprises a hollow pivoting element for receiving said connector.

Accordance to the invention, the USB connector is introduced into a housing, which enables to guarantee its integrity, whatever the external conditions. Preferably, the housing is tight, which makes the connector indifferent to moisture. It can thus provide its electric function, once extracted out of the housing.

The connector is of the male type, and can be connected directly to a socket of the external source, such as a computer port. This makes it possible not to use an external connection cable, such as in the state of the art.

The lamp according to the invention can comprise all or part of the following features, taken separately or according to any technically compatible combination:

the back support body comprises a hollow element comprising a bottom and closed side walls, and the connector is bordered by a gasket, the gasket being pressed against the walls of the hollow element, in the position of fixation.

the removable fixing means are elastic snapping fixing means.

the back support body or the front lighting device includes an elastic snapping element, able to push the gasket towards the interior of the hollow element, in the position of fixation.

the connector is a male connector.

the first module is introduced into a notch, provided into the back support body.

the power supply unit is formed by the first module, which is provided both with the accumulator and the connector.

the power supply unit includes the first module, which is provided with the connector, as well as with a second module, provided with the accumulator, these two modules being connected through electric connection means.

The invention also relates to a power supply unit belonging to a portable electric lamp, this unit including removable fixing means for the fixation to the back support body, an accumulator and a supply and communication connector, such as a Universal Serial Bus (USB), a gasket surrounding the connector in order to define, with the back support body, a tight housing for receiving the connector, in the position of fixation.

BRIEF DESCRIPTION OF THE DRAWINGS

Other advantages and features will more clearly arise from the following description of a particular embodiment of the invention given as a non-limitative example and represented in the annexed drawings, in which.

DESCRIPTION OF A PREFERENTIAL EMBODIMENT OF THE INVENTION

Figure 1:
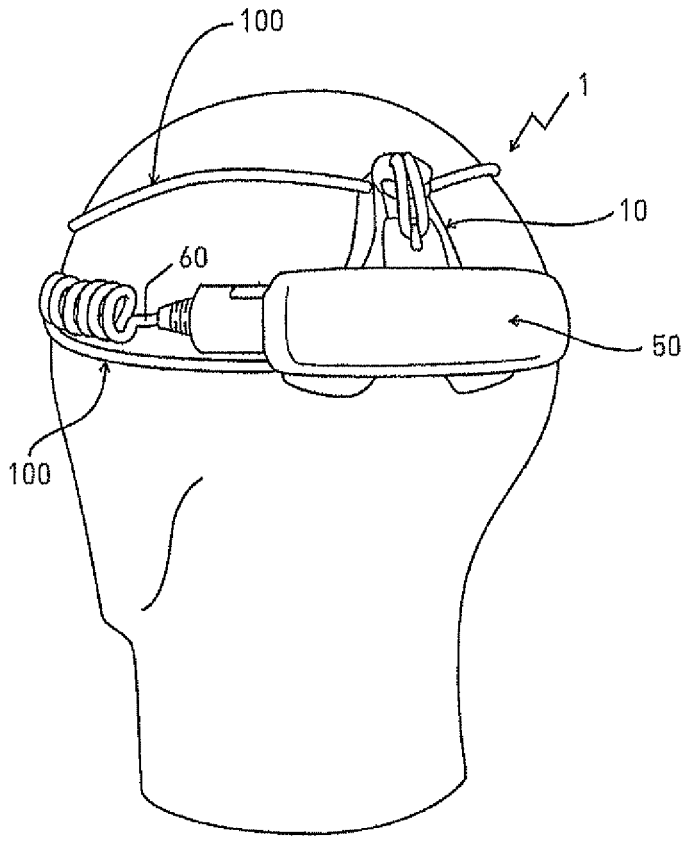
FIG. 1 is a perspective view of a portable lamp according to the invention.

Afterwards, the terms 'front', 'back, 'upper', 'lower', 'horizontal' and 'vertical' relate to a lamp carried by a user standing up with the head in the right position. The lamp 1 according to the invention first includes a front lighting device (not represented), such as a LED device or any other suitable device. By referring in particular to FIG. 1, this lamp moreover includes a back support body 10, fixed to the front device by means of fixing laces 100 or straps. In a variant, this front device and this back support body can be hold on the user's head by any other adapted means, in particular a conventional elastic headband.

In FIGS. 1 to 7, the back support body 10, which can cooperate with a power supply module 50 as it will be seen afterwards, has a triangular shape, with a horizontal base. It is provided with two contact shoes 12, for improving the user's comfort. This back support body 10 is provided with a notch 14 for receiving the module 50, which is bordered by a band 16. The latter is provided, in its median part, with an elastic strip 18, suitable to ensure the snapping of the module 50, as it will be seen hereafter.

The upper part of the support body 10 comprises two side flanges 20, on which a cap 22 is mounted, which can pivot around a transverse axis A. This cap 22 includes a closed bottom 24, two side walls 26 also closed, and an outlet 28 opposite the closed bottom 24.

The power supply module 50 comprises a case 52, composed of two parts, namely a body 54 to which a hull 56 is fixed, by any suitable means. This case 52 delimits an interior volume V, in which a reloadable accumulator 58, of any known type, is placed. This accumulator is connected, in a traditional way, with the lighting module by means of a cable 60, partially illustrated in FIG. 1.

The accumulator 58 is moreover associated with a conventional supply and communication connector 62. In the illustrated example, it is shown a male USB port (Universal Serial Bus), given that which any other type than USB can be used. The connector 62 extends out of the interior volume V, through an orifice 64 which is sealed by a gasket 66. This gasket has a flange 68, which rests against a seat 70 of the case 52. Finally, the body 54 includes an embossing 72, suitable to snappingly cooperate with the strip 18 of the support body 10.

The various phases for implementing the above-described lamp will be now clarified below.

Figure 2:
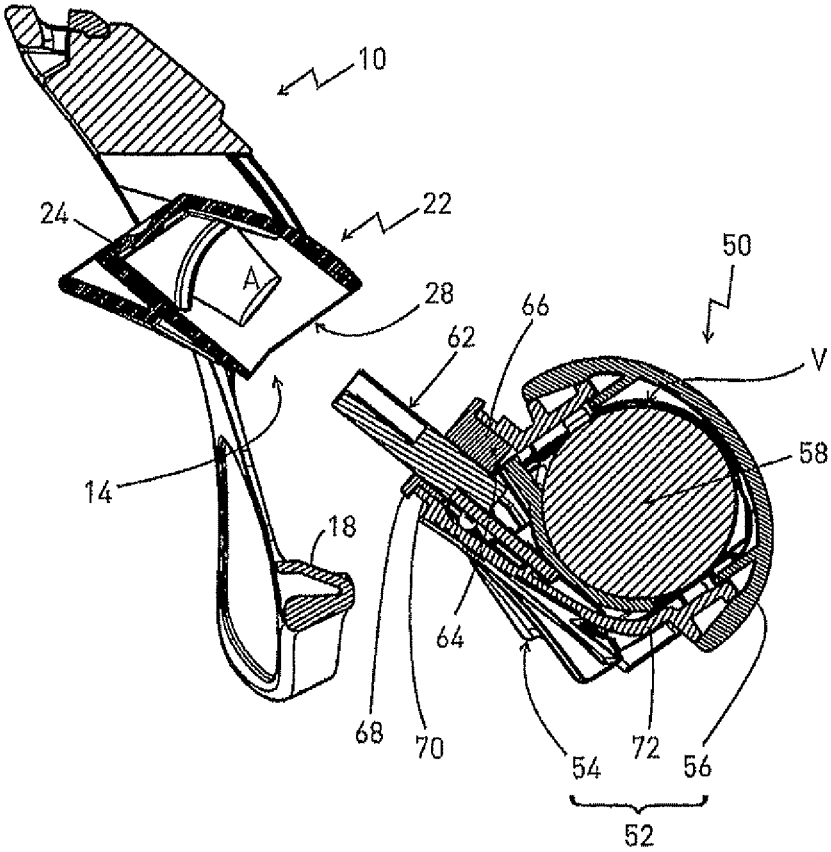
FIGS. 2 to 4 are longitudinal sectional views, illustrating on a larger scale a back support body and a power supply module belonging to this lamp, respectively in extracted, unlocked and locked positions.
Figure 5:
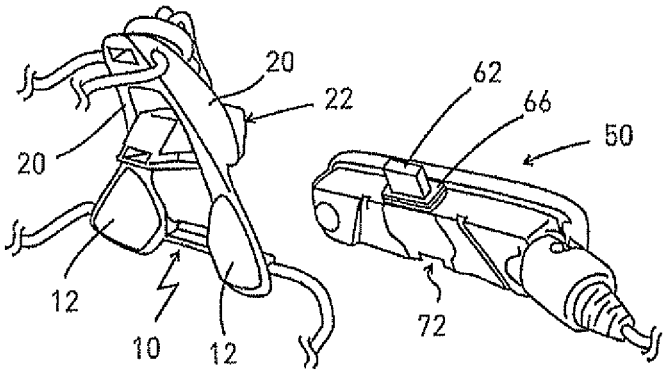

It is supposed first that the power supply module 50 is disconnected from the support body 10, which corresponds to the arrangement in FIGS. 2 and 5. Under these conditions, the connector 62 is freely accessible, so that it can be connected to an external source, either for charging it, or for programming its parameters, or both simultaneously. The presence of a male USB connector makes it possible to connect it directly to a female USB connector of a computer, or of an external source without using an additional cable.

If one wishes to fix the module 50 to the support body 10, the free end of the connector 62 must be introduced first into the cap 22. This operation is facilitated by the fact that the cap is able to pivot, which allows a simplified positioning. As the USB connector 62 is brought closer to the bottom 24 of the cap 22, the gasket 66 comes in contact with the side walls 26 of said cap. In an advantageous way, the walls 26 are slightly widened, so that their section gradually decreases at the other end of the outlet 28 of the cap. At the end of the course, as illustrated in FIGS. 3 and 6, the gasket is thus pressed against the walls of the cap.

Figure 3:
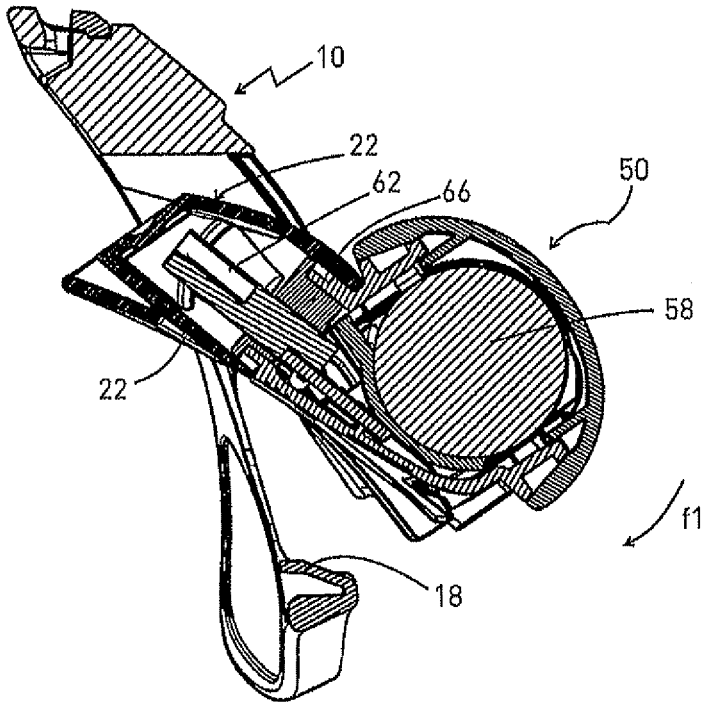
Figure 4:
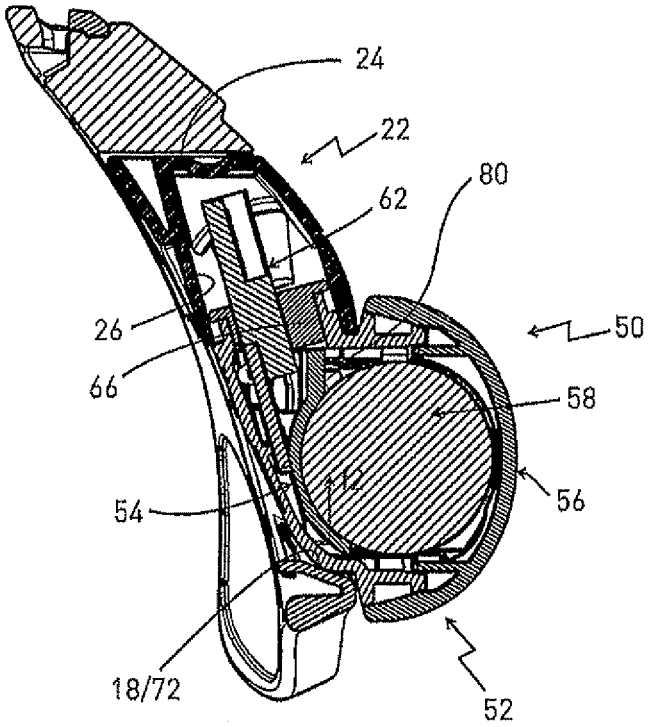
Figure 7:
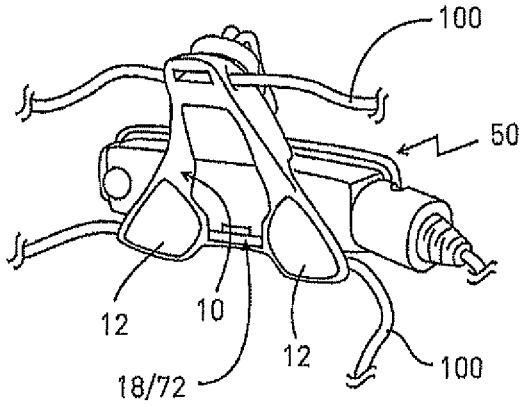
FIGS. 5 to 7 are perspective views of the back support body and the power supply module, respectively in the extracted, unlocked and locked positions.
Figure 6:
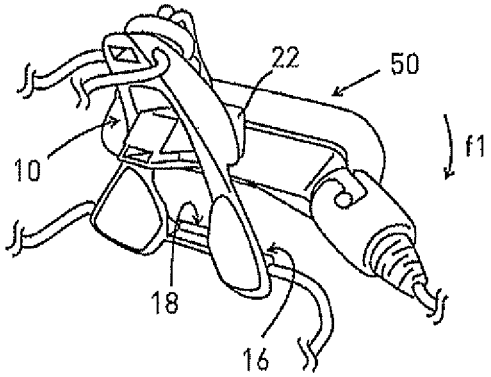

The unit, formed by the cap 22 and the power supply module 50 is then pivoted around the axis A in the direction of the arrow 11 in FIGS. 3 and 6. At the end of this movement, the embossing 72 of the module 50 comes to press the strip 18 of the support body 10, which makes it possible to immobilize this body relative to the module 50 by means of an elastic snapping operation. In this locking configuration, illustrated in FIGS. 4 and 7, the connector is received into a tight housing 80, delimited by the bottom 24 and the walls 26 of the cap 22, as well as by the interior volume of the case 52. It should be moreover noted that the strip 18 exerts a force f2, which tends to push the power supply module 50 upwards and to press the gasket 66, which still improves the tightness.

When the power supply module 50 is fixed to the support body 10, the user can use the lamp in a usual way. Then, if he/she wishes either to reload the lamp, or to modify the programming thereof, he/she causes the module to swing in the direction opposite that of the above-mentioned arrow f2, in order to disconnect the module 50 from the support body 10. Under these conditions, the lamp is again in its configuration in FIGS. 2 and 5, so that the user can reach the USB connector 62 directly.

Figure 8:
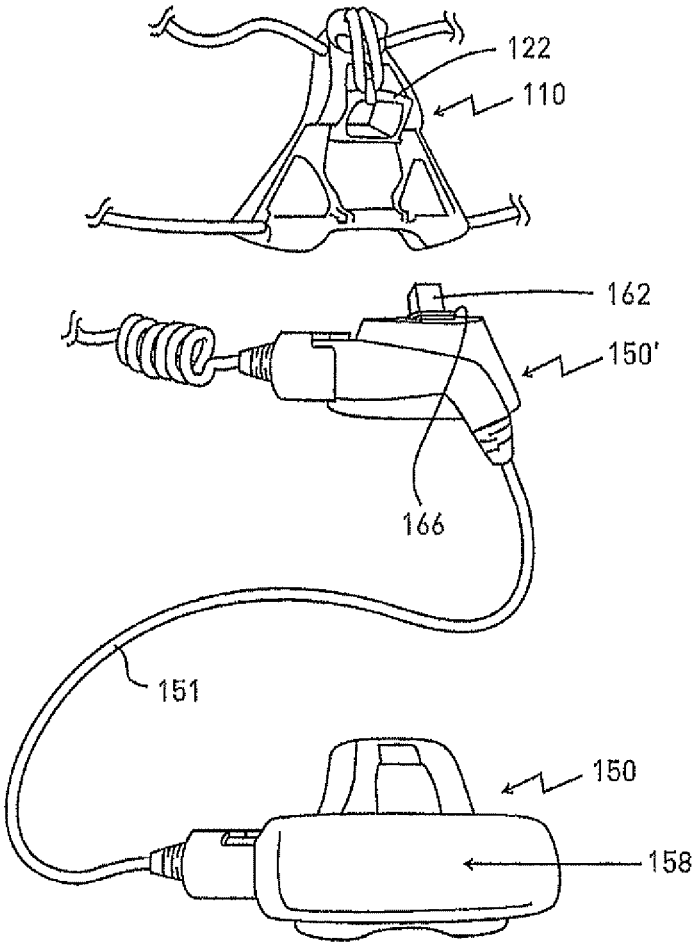
FIGS. 8 and 9 are perspective views of a variant of the invention with an off-set power supply module, illustrated respectively in extracted and locked positions.
Figure 9:
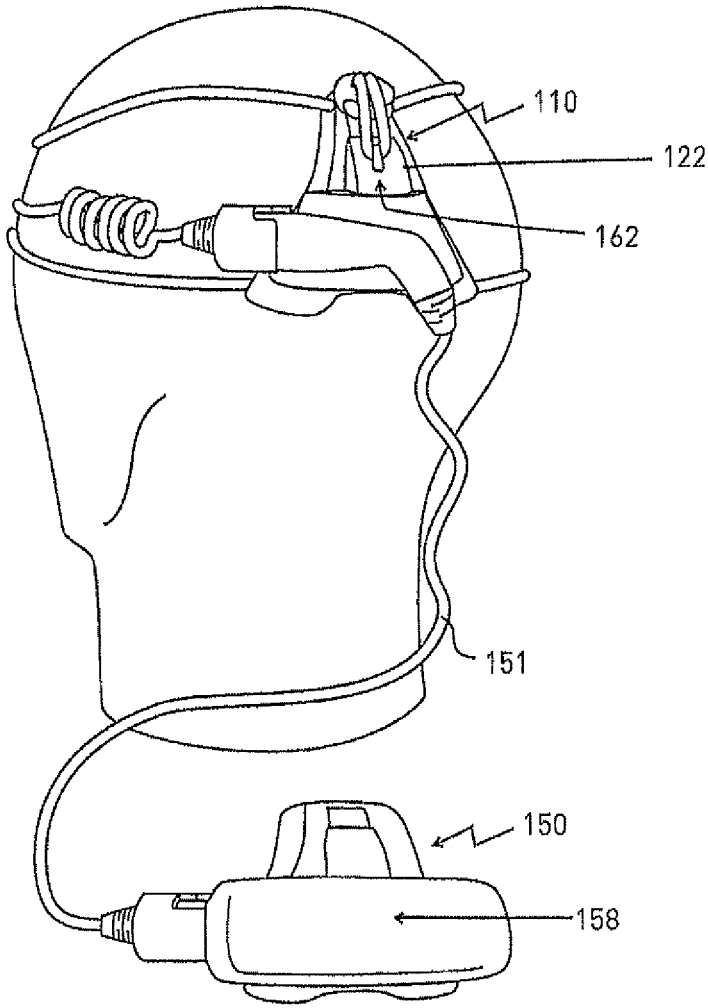

FIGS. 8 and 9 illustrate a embodiment variant according to the invention, in which the power supply module 150 is off-set. In these figures, the mechanical parts similar to those in FIGS. 1 to 7 have the same reference numbers, increased by 100.

The embodiment in FIGS. 8 and 9 provides a power supply unit formed of two modules, and not of a single module 50 as in the embodiment in FIGS. 1 to 7. In a more precise way, this unit includes first a first module 150, in the interior volume of which the accumulator 158 is received. This first module 150 is connected to a second module 150', via a connection cable 151, or any equivalent body. In addition, this second module 150' is provided with the USB connector 162, which extends through an orifice, closed by the gasket 166. Lastly, the support body 110 is structurally identical to that one 10 described above.

The implementation of the lamp in FIGS. 8 and 9 involves, as in the first embodiment, the insertion of the USB connector 162 into the cap 122, then the snapping fixation of the module 150' to the support body 110. In other words, the co-operation of this module 150' with the support body 110 is similar to that one between the single module 50 and the support body 10. The module 150 is off-set compared to the module 150', in particular in order to protect the accumulator against severe atmospheric conditions.

The invention is not limited to the described and represented examples. Thus, it can first be provided that the accumulator supply unit is not mounted on the back support body, but on the contrary on the front lighting device. In that case, that front device is for example provided with snapping means, similar or equivalent to those described above the back support body is provided with.

Moreover, it can be provided that the supply and communication connector is not a male connector, but on the contrary a female connector. In both cases, the USB connector is protected in a closed compartment, when it is in the locked position.

Finally, it can be provided that the supply and communication USB connector is not a USB connector, but a connector of any other equivalent suitable type. The type FIREWIRE™ or other will be mentioned as a purely non-limitative example.

Figure 10:
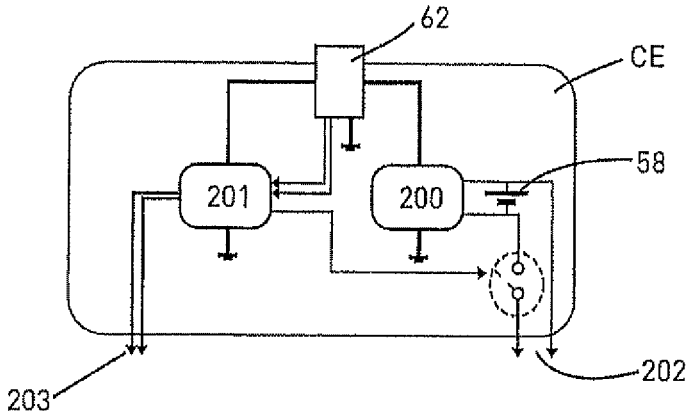
FIG. 10 shows the diagram of the electronic control board for charging the accumulator and the parameter setting of the lamp.

FIG. 10 represents the electric connecting diagram for the USB connector 62 in the power supply module 50. The USB connector is connected to an electronic board CE in the module, and including a regulating circuit 200 for the charging of the accumulator 58, and a processor 201 for adjusting the parameters of the lamp. The output of the accumulator 58 is connected through power conductors 202 to the lighting module for supplying the lamp. The output of the processor 201 is connected through a data bus 203 to the same lighting module for the parameter setting for the lamp operation. Four conductors 202 and 203 are arranged in the same sheath constituting cable 60 in FIG. 1.

The invention claimed is:

1. A power supply unit for a portable electric lamp, such unit comprising:

a back support body comprising means for holding the back support body on a user's head, wherein said means for holding are configured to connect the back support body to a lighting device;

an accumulator;

at least one first module comprising a Universal Serial Bus (USB) connector for providing a power supply and communication connection, and means for removably securing the at least one first module to the back support body;

wherein the back support body further comprises a hollow cap-shaped element pivotably mounted about a transverse axis on the back support body, the hollow cap-shaped element receiving said USB connector when the at least one first module is secured to the back support body.

2. The power supply unit according to claim 1, wherein the USB connector is a male connector.

3. The power supply unit according to claim 1, wherein a notch is provided in the back support body for receiving the at least one first module.

4. The power supply unit according to claim 1, wherein the at least one first module includes both the accumulator and the USB connector.

5. The power supply unit according to claim 1, further comprising a second module housing the accumulator, and electric connection means connecting the at least one first module and the second module.

6. The power supply unit according to claim 1, wherein the at least one first module is pivotably mounted about a transverse axis of the back support body.

7. The power supply unit according to claim 1, further comprising:

a gasket surrounding the USB connector;

wherein the hollow cap-shaped element has a bottom and closed side walls, and the gasket is pressed against the walls of the hollow element when the at least one first module is secured to the back support body.

8. The power supply unit according to claim 7, wherein the removable fixing means are snapping fixing means.

9. The power supply unit according to claim 8, wherein the back support body includes an elastic snapping element for pushing the gasket towards the interior of the hollow element when the at least one first module is secured to the back support body.

* * * * *